United States Patent [19]

Kasai et al.

[11] Patent Number: 4,798,310

[45] Date of Patent: Jan. 17, 1989

[54] ARTICLE STORAGE CONTAINER

[75] Inventors: Kikuo Kasai, Tokyo; Kimio Kodera, Saitama; Mitsuo Maki, Tokyo, all of Japan

[73] Assignee: Platinum Pen Co., Ltd., Tokyo, Japan

[21] Appl. No.: 5,276

[22] Filed: Jan. 20, 1987

[30] Foreign Application Priority Data

May 20, 1986 [JP] Japan ..... 61-113682

[51] Int. Cl.[4] ..... G07F 11/00

[52] U.S. Cl. ..... 221/87; 206/224; 206/371; 206/252; 211/69.5

[58] Field of Search ..... 221/87, 88; 206/224, 206/371, 214, 252; 211/69.1, 69.2, 69.5, 69.8, 69.9; 401/88, 92–94, 131; 15/435

[56] References Cited

U.S. PATENT DOCUMENTS

| | | | |
|---|---|---|---|
| 3,854,825 | 12/1974 | Girella | 401/94 |
| 4,106,874 | 8/1978 | Torii | 401/67 |
| 4,355,726 | 10/1982 | Mutschler | 211/69.5 |
| 4,562,923 | 1/1986 | Katada et al. | 206/371 |

FOREIGN PATENT DOCUMENTS

| | | | |
|---|---|---|---|
| 1961030 | 5/1967 | Fed. Rep. of Germany . | |
| 1251343 | 12/1960 | France | 211/69.5 |
| 347181 | 8/1959 | Japan . | |
| 59-145311 | 9/1984 | Japan . | |
| 59-148713 | 10/1984 | Japan . | |
| 59-155016 | 10/1984 | Japan . | |
| 1461340 | 1/1977 | United Kingdom . | |

*Primary Examiner*—H. Grant Skaggs

*Attorney, Agent, or Firm*—Cushman, Darby & Cushman

[57] ABSTRACT

An article storage container comprising; a case including an accommodation chamber having an opening in an end thereof, a retainer for holding an article within the chamber, and a change-over mechanism attached to the retainer. The change-over mechanism is adapted to displace the retainer and to change its position alternately between an accommodated position in which the article is completely inserted within the opening of the case and an ejecting position in which the article is partially projecting above the opening of the case through manual pressing action against the article inserted within the chamber.

9 Claims, 3 Drawing Sheets

ARTICLE STORAGE CONTAINER

BACKGROUND OF THE INVENTION

This invention relates to an article storage container for storing office utensils such as pencils and stamps, commodities such as cigarette lighters, cosmetics, medicine and flash lights, industrial tools such as measuring tools and gauges, miscellaneous goods, furniture and automobile parts.

In usual fashion, writing utensils are enclosed in a pencil case or a sheath case, and cosmetics are thrown into a bag at random. As prior art concerning this fashion, Japanese Utility Model Public Disclosure No. 148713/1984 discloses a storage container in which an article enclosed in a case is held by an elastic clamp ring, and when the article is taken out from the container, a button attached to an inlet portion is pushed, so that a flange portion formed in the article is pulled thereby the article being ejected. Japanese Utility Model Public Disclosure No. 155016/1984 discloses a storage container in which an article is inserted into the container pressing against a spring in the case thereby being locked in a hold position, and when the article is taken out from the container, a button located inside of the case is pushed in order to release a spring compression, so that the article is projected above the case due to a bias force of the spring.

However, in the above two prior art documents, when the article is taken out from the case, a button handling action is needed in a different manner from the opening action of the case, resulting in bothering operation. Furthermore, since an operating button is exposed on a surface of the case, it often hits miscellaneous parts thereby causing unintentional malfunction.

SUMMARY OF THE INVENTION

It is an object of the present invention to solve the above problems and to provide an article storage container in which a simplified pressing action enables the user to accommodate and eject the article, and safe and reliable operation is estabilished without causing malfunction.

The foregoing and other objects of the invention are accomplished by providing an article storage container comprising a case including an accommodation chamber, said chamber having an opening at an end thereof, a retainer for holding an article within said chamber, and a change-over mechanism attached to said retainer, said change-over mechanism being adapted to displace said retainer and to change its position alternately between an accommodated position in which said article is completely inserted within said opening of the case and an ejecting position in which said article is partially projecting above said opening of the case through pressing action against the article inserted within said chamber.

Other features and advantages of the invention will become apparent from the following description of embodiments with reference to the accompanying drawings.

DESCRIPTION OF THE PREFERRED EMBODIMENT

Figure 1:
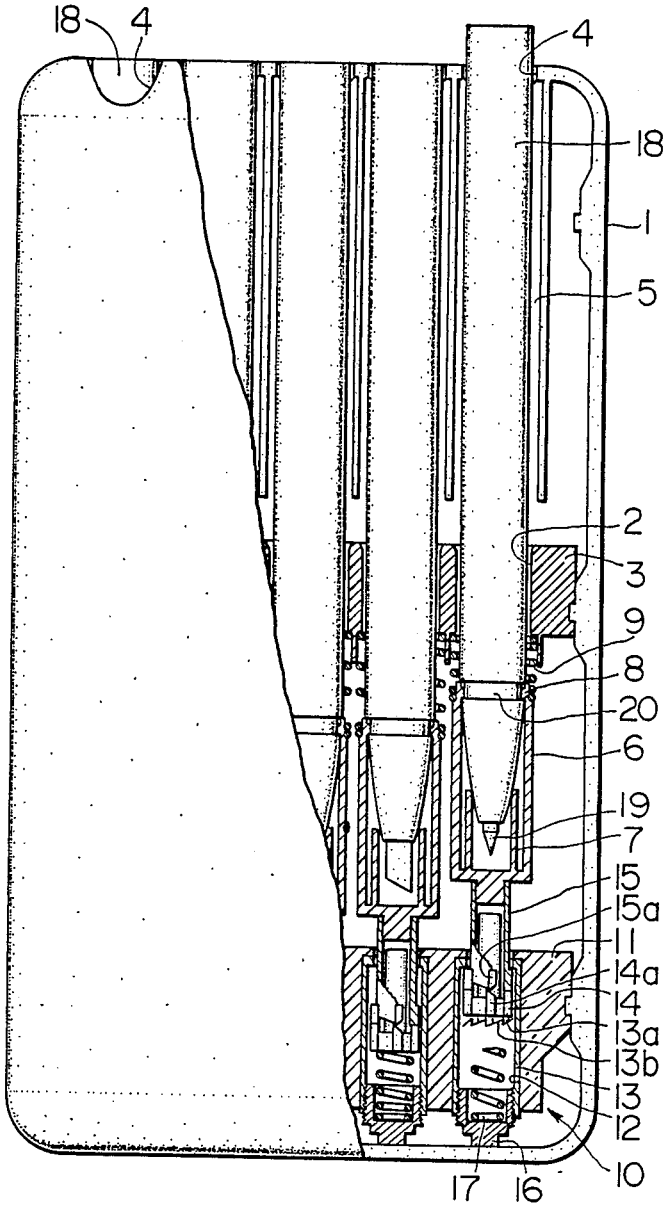
FIG. 1 is a front view, partly in cross section, of a storage container according to the invention.
Figure 3:
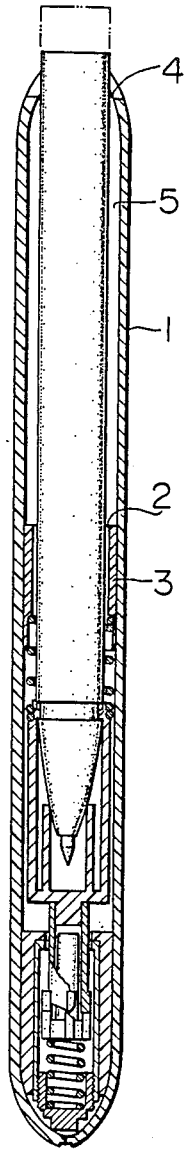
FIG. 3 is a vertical sectional view of FIG. 2.
Figure 2:
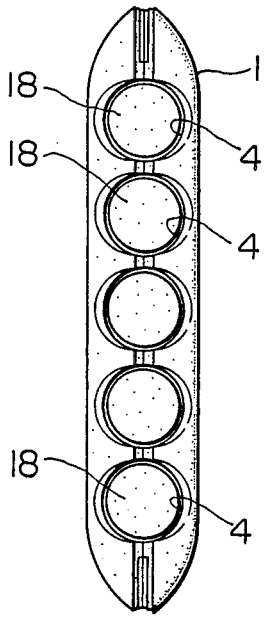
FIG. 2 is a top plan view of FIG. 1.

Referring to FIGS. 1, 2 and 3, there is shown a first embodiment of the invention, which is an embodiment of a storage container for accommodating writing utensils. The numeral 1 designates a case consisting of two pieces, an upper portion and a lower portion, which provide a hollow and flat rectangular box. Within the case 1, a supporting block 3 having several spaced slots 2 is centrally situated traversing the inside of the case. Above each slot 2 of the supporting block 3, is located a cylindrical accommodation chamber 5 provided with an opening 4 at the upper end thereof. In a lower portion of each slot 2, a retainer 6 and a change-over mechanism 10 are located within the case 1. The retainer 6 is shaped so as to have a cylindrical form having a bottom portion in which an inner barrel 7 for keeping airtight is vertically disposed. In an inside surface of an upper opening of the retainer 6, a retaining projection 8 is provided for engaging with a writing utensil. Between a step portion formed in a top outside surface of the retainer 6 and the supporting block 3, a coil spring 9 is disposed. The change-over mechanism 10 can be constituted by a well know rachet cam mechansim or a heart cam mechanism, thereby providing a shiftable, spring-biased camming means. In this embodiment, a rachet cam mechanism typically disclosed in Japanese Patent Publication No. 7181/1959 is employed. Within a circular slot 12 formed in a mounting block 11, is fitted a stationary cam barrel 13 in which a rotary cam barrel 14 and an actuating cam barrel 15 are slidably mounted. An upper end of the actuating cam barrel 15 is fixedly connected to said retainer 6. Between a bottom surface of the rotary cam barrel 14 and a plug 16 inserted within a bottom end of the stationary cam barrel 13, a coil spring 17 having a stronger bias force than that of said spring 9 is disposed, so that an upward directing cam element 14*a* formed in the rotary cam barrel 14 and a downward directing cam element 15*a* formed in the actuating cam barrel 15 are constantly abutting. Simultaneously, the cam element 14*a* in the cam barrel 14 is kept in abutment with one of two stage cam slots 13*a* (deep side), 13*b* (shallow side) both formed inside of an upper portion of the stationary cam barrel 13 in order to exchange its position alternately. The writing utensil 18 includes a lead 19 in a tip thereof and a locking cavity 20 in an edge of a grip portion thereof.

Since the storage container is thus constructed, when the writing utensil is accommodated in the case, the utensil is inserted from the opening 4 of the case 1 into the accommodation chamber 5, with the tip lead 19 being engaged with the inner barrel 7 and the locking cavity 20 being engaged with the projection 8. As the utensil 18 is inserted further inside, the retainer 6 is displaced downwardly, with the actuating cam barrel 15 of the change-over mechanism 10 connected to the retainer 6 following downwardly against a bias force of the spring 17. Since the rotary cam barrel 14 is abutting against the cam barrel 15, it also follows downwardly along the deep cam slot 13*a* of the stationary cam barrel 13 thereby to project in downward direction. Simultaneously, the rotary cam barrel 14 is rotated by the cam element 15*a* of the actuating cam barrel 15 permitting the cam element 14*a* to transfer from the deep cam slot 13*a* to the shallow cam slot 13*b*. When the push down action of the utensil 18 is ceased, the cam element 14*a* slightly moves upward and abuts against the shallow cam slot 13*b* in lower position than the deep cam slot 13*a*, whereby the retainer 6 connected to the actuating cam barrel 15 abutting against the rotary cam barrel 14 is held in a lower position than the initial position before the utensil 18 is inserted. Thus, the utensil 18 held in the retainer 6 is disposed in the accommodation chamber 5 with the upper end thereof being kept in a position flush with the surface of the opening 4 of the case 1.

When the utensil 18 is ejected from the case 1, the upper end of the utensil 18 is pressed inside further downward below the opening 4, and then the actuating cam barrel 15 connected to the retainer 6 is displaced downwardly causing the cam element 15*a* to push down the cam element 14*a* of the rotary cam barrel 14, whereby the engagement between the cam element 14*a* and the shallow cam slot 13*b* of the stationary cam barrel 13 is released. As a result, the rotary cam barrel 14 is rotated along a slope of the cam element 15*a*, and the cam element 14*a* moves toward a lower position of the deep cam slot 13*a*. When the push down action of the utensil 18 is ceased, bias force of the spring 17 urges the rotary cam barrel 14 to move upward, with the cam element 14*a* moving upward toward the upper end of the deep cam slot 13*a*. Accordingly, the retainer 6 connected to the rotary cam barrel 14 moves upward against bias force of the spring 9, and the utensil 18 held in the retainer 6 also moves upward. Thus, the upper end of the utensil 18 projects above the opening 4 of the case 1 as shown in a dotted line of FIG. 3, so that when the upper end of the utensil 18 is gripped and withdrawn the locking cavity 20 is disengaged from the projection 8 of the retainer 6, whereby the untensil 18 can be taken put from the case 1.

Figure 4:
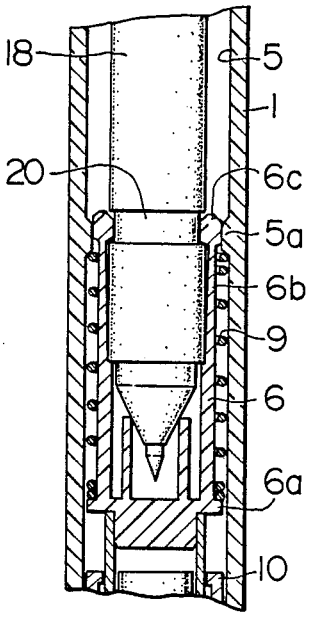
FIG. 4 is a fragmentary vertical sectional view illustrating a principal section of a second embodiment of the invention as the article is held in an accommodated position.
Figure 5:
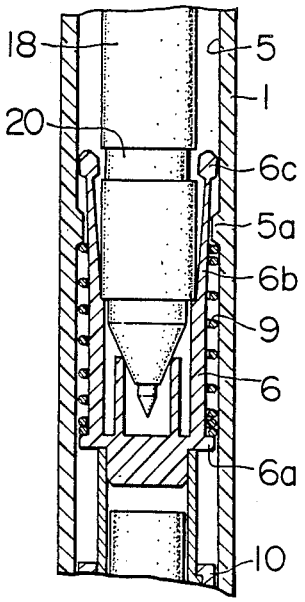
FIG. 5 is a fragmentary vertical sectional view similar to FIG. 4 as the article is moved to an ejecting position.

FIG. 4 and FIG. 5 illustrate a second embodiment of the incention, in which the engaging mechanism between the utensil 18 and the retainer 6 in the first embodiment is modified. An engaging projection 5*a* is formed in the wall surface of the accommodation chamber 5 of the case 1, while an extending flange 6*a* is formed in the lower portion of the retainer 6, with the coil spring 9 being disposed between the flange 6*a* and the projection 5*a*. In the upper end of the retainer 6, a chuck element 6*b* split around circumferential direction is formed in longitudinally extending fashion with an engaging protrusion 6*c* projecting both inside and outside provided at the tip end of the retainer 6. Other constructions of the constituent elements are the same as in the first embodiment.

Thus, when the utensil 18 is accommodated in the case 1, the tip end of the utensil 18 is abutted against the retainer 6 and the moved downwardly, whereby the engaging protrusion 6*c* of the chuck element 6*b* of the retainer 6 is forced to abut against the engaging projection 5*a* of the chamber 5 thereby depressing the chuck element 6*b* inwardly to reduce the outside diameter thereof. Then, the engaging protrusion 6*c* engages with the locking cavity 20 of the utensil 18 to hold the utensil 18 in its position, whereby the utensil 18 is accommodated in the chamber 5 in stable fashion. When the utensil 18 is ejected from the case 1, the chuck element 6*b* moves upward following upward movement of the retainer 6, with the engaging protrusion 6*c* being released from the projection 5*a* of the chamber 5, whereby the protrusion 6*c* is disengaged from the cavity 20 of the utensil 18. As a result, the utensil 18 can be taken out from the case 1 in association with the upward movement of the retainer 6.

In the above embodiments, several utensils are enclosed in the case in parallel fashion. Alternatively, such embodiment as a single utensil is enclosed in a case may be constructed.

Instead of utensils, other office goods, commodities, and industrial tools may be accommodated in the case. Also it is possible to assemble the accommodation chamber with furniture such as a desk or with a dashboard of a motor vehicle.

As may be understood from the above description accompanying the several embodiments, according to the invention, through simple manual pressing action of the accommodated article the change-over mechanism in the case is actuated, and the position of the retainer is alternately exchanged between a lower accommodated position and an upper ejecting position. Thus, simple action is sufficient to accommodate an article into a case in stable fashion and to eject from the case in association with a self-projecting movement. Since the article is completely accommodated within the case, there is no trouble or malfunction caused by unintensional pressing action due to a collision of some external portion with miscellaneous parts. In conclusion, a safe and stable article storage container is provided with considerably small cost.

I claim:

1. An article-storage container for at least one elongated article having an inner end, an outer end and a sidewall extending therebetween, with a first retaining means provided externally on the sidewall of the article, said article-storage container comprising:

a case including means defining at least one article-accommodation chamber for removably telescopically receiving, inner end first, a respective said article, said article-accommodation chamber having an opening through said case at an end of said article-accommodation chamber, said article-accommodation chamber being closed at an opposite end by means including an article retainer;

said article retainer being mounted in said case for limited axial movement towards and away from said opening;

resilient means mounted in said case and normally urging said article retainer towards said opening;

said article retainer including second retaining means adapted to engage with said first retaining means for removably retaining said article in said articleaccommodation chamber; and a change-over mechanism including a shiftable spring-biased camming means, said change-over mechanism being mounted and disposed in said case, being operatively associated with said article retainer and said resilient means and being arranged:

for disposing said article retainer in an axially outer position with said second retaining means poised for retainingly coacting with said first retaining means when said article has been inserted in said article-accommodation chamber sufficiently to bring said first retaining means into engagement with said second retaining means and for permitting said article retainer, against restoration force becoming stored by said resilient means, to permit said article retainer to be forcibly retracted to an intermediate position as said article is further inserted into said article-accommodation chamber, until a condition is reached at which said first retaining means is retainingly engaged with said second retaining means, said outer end of said article is approximately flush with said case perimetrically of said opening and said article retainer is cammed, by said spring-biased camming means of said change-over mechanism, in said intermediate position, against axially outward movement towards said axially outer position, and for permitting said article retainer when latched in said intermediate position to be pushed further inwards, by a pushing force manually applied on said outer end of said article, for shifting said spring-biased camming means so that said resilient means may push said article outwardly of said articleaccommodation chamber so that a portion of said article adjacent said outer end protrudes out of said case through said opening and is available to be grasped for removing said article from said article-accommodation chamber.

2. An article-storage container, comprising:

a case including means defining at least one articleaccommodation chamber having an opening through said case at an end of said article-accommodation chamber, said articleaccommodation chamber being closed at an opposite end by means including an article retainer;

an elongated article having an inner end, an outer end and a sidewall extending therebetween and being adapted to be removably telescopically received in said accommodation chamber, inner end first;

a first retaining means provided externally on said sidewall of said article;

said article retainer being mounted in said case for limited axial movement towards and away from said opening;

resilient means mounted in said case and normally urging said article retainer towards said opening;

said article retainer including second retaining means adapted to engage with said first retaining means for removably retaining said article in said article-accommodation chamber; and a change-over mechanism including a shiftable spring-biased camming means, said change-over mechanism being mounted and disposed in said case, being operatively associated with said article retainer and said resilient means and being arranged:

for disposing said article retainer in an axially outer position with said second retaining means poised for retainingly coacting with said first retaining means when said article has been inserted in said article-accommodation chamber sufficiently to bring said first retaining means into engagement with said second retaining means and for permitting said article retainer, against restoration force becoming stored by said resilient means, to permit said article retainer to be forcibly retracted to an intermediate position as said article is further inserted into said article-accommodation chamber, until a condition is reached at which said first retaining means is retainingly engaged with said second retaining means, said outer end of said article is approximately flush with said case perimetrically of said opening and said article retainer is cammed, by said spring-biased camming means of said change-over mechanism, in said intermediate position, against axially outward movement towards said axially outer position, and for permitting said article retainer when latched in said intermediate position to be pushed further inwards, by a pushing force manually applied on said outer end of said article, for shifting said spring-biased camming means so that said resilient means may push said article outwardly of said article-accommodation chamber so that a portion of said article adjacent said outer end protrudes out of said case through said opening and is available to be grasped for removing said article from said article-accommodation chamber.

3. The article-storage container of claim 2, wherein: said elongated article is a writing instrument having a writing tip provided at said inner end thereof.

4. The article-storage container of claim 3, wherein: said article retainer includes an inner barrel portion adapted for removably air-tightly cappingly receiving an inner end portion of said writing instrument, including said writing tip, as said writing instrument upon becoming received in said article-accommodating chamber, engages said article retainer.

5. The article-storage container of claim 4, wherein: said writing instrument is a pen.

6. The article-storage container of claim 2, wherein: said case is provided with a plurality of said article-accommodation chambers, each having a respective opening through said case, each case having a respective said article removably received therein and each said article including a respective said first retaining means;

said case further including for each said article-accommodation chamber a respective said article retainer, a respective said resilient means, including a respective said second retaining means, and a respective said change-over mechanism.

7. The article-storage container of claim 6, wherein: said case is relatively flat and said openings are provided in a single row through an end wall of said case.

8. The article-storage container of claim 2, wherein: said article retainer is adapted to latch said first retaining means with said second retaining means when said article engages said article retainer in said outer portion of said article retainer.

9. The article-storage container of claim 2, wherein: said second retaining means is normally biased laterally outwardly away from latching engagement with said first retaining means except when said article retainer is disposed axially further from said opening that it is when disposed in said axially outer position, whereby said article is automatically latched and released as said article in being telescopically received pushes said article retainer from said outer position towards said intermediate position and in being withdrawn permits said article retainer to be moved by said resilient means past said intermediate position towards said outer position.

* * * * *